US011193070B1

(12) United States Patent
Boyer et al.

(10) Patent No.: US 11,193,070 B1
(45) **Date of Patent: *Dec. 7, 2021**

(54) SEEDED MESOPHASE PITCH PROCESS

(71) Applicants: David C Boyer, Palm Coast, FL (US); Thomas C Holcombe, Hillsborough, NJ (US)

(72) Inventors: David C Boyer, Palm Coast, FL (US); Thomas C Holcombe, Hillsborough, NJ (US)

(73) Assignee: Advanced Carbon Products, LLC, Hitchens, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/929,886

(22) Filed: May 28, 2020

Related U.S. Application Data

(63) Continuation-in-part of application No. 15/899,816, filed on Feb. 20, 2018, now Pat. No. 10,731,084.

(51) Int. Cl.
*C10C 3/00* (2006.01)
*C10C 3/02* (2006.01)

(52) U.S. Cl.
CPC ..... *C10C 3/002* (2013.01); *C10C 3/02* (2013.01)

(58) Field of Classification Search
None
See application file for complete search history.

(56) References Cited

U.S. PATENT DOCUMENTS 4,705,618 A * 11/1987 Tsuchitani ..... C10C 1/08 208/40
5,614,164 A 3/1997 Sumner et al.
7,341,656 B1 3/2008 Malone et al.
9,222,027 B1 * 12/2015 Malone ..... C10C 3/002
9,376,626 B1 * 6/2016 Malone ..... C10C 3/023

* cited by examiner

*Primary Examiner* — Tam M Nguyen
(74) *Attorney, Agent, or Firm* — Richard D. Stone

(57) ABSTRACT

Producing mesophase pitch from liquid hydrocarbon feed comprising multi-ring aromatic compounds. In a first stage reactor feed is converted to isotropic pitch product contaminated with mesophase pitch. Contaminated isotropic pitch is charged to a second stage reactor where mesophase formation by self-assembly into spherical crystal clusters produces a mesophase pitch product. Water or steam added to the first stage reactor increases conversion of aromatic liquid feed, increases mesophase contamination of isotropic pitch product and reduces coke formation in the isotropic pitch reactor.

16 Claims, No Drawings

SEEDED MESOPHASE PITCH PROCESS

CROSS REFERENCE TO RELATED APPLICATIONS

This application is a continuation in part of our prior application Ser. No. 15/899,816 filed Feb. 20, 2018, which claimed the benefit of prior provisional application No. 62/600,402, filed Feb. 21, 2017. Our two recent patents, U.S. Pat. Nos. 9,222,027 and 9,376,626 are related. These patents and applications are incorporated herein by reference.

BACKGROUND OF THE INVENTION

This invention relates to the formation of mesophase pitch. Pitch is useful for the production of carbonized fibers, carbon foam and other carbon or pitch based products.

Our invention started with an accident. Accidents can lead to exceptional results, such as one reported by the Goodyear company https://corporate.goodyear.com/en-US/about/history/charles-goodyear-story.html.

"The great discovery came in the winter of 1839. Goodyear was using sulfur in his experiments now. Although Goodyear himself has left the details in doubt, the most persistent story is that one February day he wandered into Woburn's general store to show off his latest gum-and-sulfur formula. Snickers rose from the cracker-barrel forum, and the usually mild-mannered little inventor got excited, waved his sticky fistful of gum in the air. It flew from his fingers and landed on the sizzling-hot potbellied stove. When he bent to scrape it off, he found that instead of melting like molasses, it had charred like leather. And around the charred area was a dry, springy brown rim—"gum elastic" still, but so remarkably altered that it was virtually a new substance. He had made weatherproof rubber. This discovery is often cited as one of history's most celebrated "accidents"."

It will be helpful in understanding our invention to review the history of pitch and special properties of one type, mesophase, which is a liquid crystal. After this review, our accident which was at first rejected by us will be reviewed.

Use of pitch, for sealing baskets of reeds floating in the river, or for sealing Noah's ark, is reported in the Bible. "Make thee an ark . . . pitch it within and without with pitch." Genesis 8: 14.

With the rise of great sailing ships, made of wood, use of pitch increased. Wood tar pitch was the primary pitch product for millennia, but was gradually displaced by pitch derived from coal and, eventually, from petroleum. All pitch processes are similar. All start with a relatively low molecular weight liquid material and add heat. Cooking pine produces pine tar, with further heating yielding wood tar pitch. Cooking coal produces coal tar, with further heating, or at least fractionation, producing coal tar pitch. When a heavy, aromatic refinery bottoms stream is heated to induce thermal polymerization, petroleum tar and, eventually, petroleum pitch is formed.

Today, little wood tar pitch is made or used. Coal tar pitch is used for roofing, coatings, in anodes and for other applications, but there are growing concerns about carcinogens, released during the coal tar pitch manufacturing process and in the use of the finished product. Some states bar coal tar-based products, because of concerns about toxicity. Petroleum pitch is commercially available and is now used for many coal tar pitch applications.

When pitch is made from oil, or other feedstocks with multi-ring aromatic compounds, the oil is heated to induce thermal polymerization and form, at first, isotropic pitch. If isotropic pitch is heated and treated further it can form a liquid with crystal properties—this is mesophase pitch. For many applications such as spinning carbon fiber or graphitic foam, high carbon content pitches are required. Many high tech applications start with mesophase pitch or high softening point isotropic pitch. The industry has tried to develop better ways of making such pitches.

There has been continual tension between product properties required and problems with the use of various pitch products. In the early 1960's, a patentee reported that "Because of the stringent requirements, commercial pitch binders have been almost exclusively made from selected coal tar products." U.S. Pat. No. 3,140,248, Jul. 7, 1964. That patentee, a petroleum refiner, reported several old "tricks" used to make high softening point material, which were reported not to work when binder pitch was desired, and a new trick which was alleged to work. Coal tar made better pitch, for some purposes, but its carcinogens could harm the environment or people working around the pitch.

The "old" methods of making binder pitch from petroleum started with catalytic cracking, to produce an aromatic rich bottoms material and limited thermal cracking of this aromatic rich material to produce "thermal asphalt", followed by "soaking" for 3-5 hours in a soaking tank. This approach made pitch, but frequently the pitch was contaminated with coke and the soaking tank coked up. The improvement of the '248 patent was a continuous process. The aromatic rich feed was still thermally cracked to produce a "thermal asphalt", but the thermal asphalt was then upgraded in a continuous process utilizing "short residence times and high lineal velocities" to make binder pitch. Thermal asphalt was upgraded to pitch in a soaking coil, in a furnace operating at carefully controlled conditions, including a residence time of at least about 4 minutes and no greater than 20 minutes. By using a flowing coil for "soaking" and limiting the soaking time to minutes instead of hours, it was reported possible to make pitch product with satisfactory properties.

Making high softening point pitch, with a softening point above 250° F., was difficult. Pitch producers tried operating under a vacuum (to reduce the temperature required to remove volatiles) and/or operating with a wiped film evaporator, relying on thin films and brute force mechanical wiping to prevent the pitch from staying for a long time in contact with a hot metal wall.

Several other pitch processes will be reviewed, to show how much work has been done on pitch manufacturing. All patents mentioned in this specification are incorporated by reference in their entirety. Processes related to isotropic pitch production are reviewed first followed by a review of several mesophase pitch patents.

U.S. Pat. No. 2,752,290, assigned to Cabot, disclosed a continuous process for making pitch.

U.S. Pat. No. 2,768,119, filed Dec. 31, 1952, assigned to Phillips Petroleum, taught making petroleum pitch. An aromatic extract was prepared by solvent extraction, then thermally cracked to produce a fuel oil fraction from which pitch was recovered by vacuum distillation. The patentee reported that pitch could be made from petroleum and had many of the properties of coal tar pitch. The vacuum distillation conditions included a "pressure of about 1 mm Hg, a temperature in the range 440 to 650° F." Presumably the vacuum distillation step was used to remove sufficient volatile matter to produce a product with the desired softening point (188 to 240° F. reported in the patent) without rapidly coking the distillation apparatus.

U.S. Pat. No. 2,992,181, assigned to Sinclair Refining, disclosed making petroleum pitch.

U.S. Pat. No. 3,140,248, filed Mar. 6, 1962, assigned to Socony Mobil, taught making binder pitch by thermal cracking at 800 to 1050° F., at pressures of 250-900 psig, to produce "thermal asphalt" having a softening point of 130 to 170° F. The thermal asphalt passed through a continuous soaking zone maintained at 940 to 1020° F., with a liquid residence time of 4 to 20 minutes, preferably 7 to 15 minutes. The soaking zone operated at 30-400 psig, preferably 100-200 psig, to limit formation of excess coke in the pitch binder product.

U.S. Pat. No. 3,692,663, assigned to Osaka Gas, taught heating a tar fraction to 320-470° C. to make gas oil and pitch.

U.S. Pat. No. 3,928,170 taught injecting hot gas into heavy oil to make pitch.

U.S. Pat. No. 3,974 and U.S. Pat. No. 4,026,788, McHenry, taught pitch manufacture with inert gas sparging.

U.S. Pat. Nos. 3,976,729 and 4,017,327, Lewis, taught making pitch with agitation during heat treatment.

U.S. Pat. No. 4,039,423, assigned to Gulf Oil, taught heating, flashing and "oxy-activation" to make pitch.

U.S. Pat. No. 4,066,737, assigned to Koppers, describes an oxidative pitch process, which was part of a method of making carbon fibers.

U.S. Pat. No. 4,242,196 assigned, inter alia to Sumitomo Metal, taught heating a resid to 450-520° C. in a tubular heater for 0.5-15 minutes, then passing an inert gas at 400-2000° C. for direct contact heating for ½-10 hours, to make pitch.

U.S. Pat. No. 4,243,513, assigned to Witco, taught treating clarified slurry oil at 390-410° C. for 2+ hours, under reflux, to make pitch.

U.S. Pat. No. 4,340,464, assigned to Sinclair Refining, Method for Thermal Cracking of Heavy Petroleum, taught how to make pitch.

U.S. Pat. No. 4,431,512, assigned to Exxon, taught heat soaking steam cracker tar middle distillate at 420-440° C. for 2-6 hours, then vacuum stripping. Their U.S. Pat. No. 4,427,530 disclosed a similar process, using FCC bottoms as feed.

U.S. Pat. No. 4,522,701, assigned to DuPont, taught making pitch by heat soaking FCC residue fractions.

U.S. Pat. No. 4,673,486 taught treating a solvent deasphalted fraction with a carrier gas and thermal cracking at 400-600° C. to produce gas oil and pitch products.

U.S. Pat. No. 4,961,837, assigned to Intevep, Caracas, Venezuela, taught making petroleum pitch for use as pitch binder.

U.S. Pat. No. 4,999,099 taught use of an oxidative purge gas to make mesophase pitch. An FCC heavy resid fraction was heat soaked at 385° C., then subjected to an $O_2$+$N_2$ sparge.

U.S. Pat. No. 5,540,832, assigned to Conoco Inc., taught making mesophase pitch from refinery decant oil residue by heat soaking at 386° C. for 28 hours with N2 agitation.

Ashland Petroleum has a series of patents on high softening point pitches, primarily for manufacture of carbon fiber. Their U.S. Pat. No. 4,671,864 taught vacuum flashing, or use of a wiped film evaporator (WFE), to reduce residence time of pitch at high temperature and make pitch having a softening point of about 250° C. U.S. Pat. No. 5,238,672 taught heating isotropic pitch with inert gas, at high temperature, to make mesophase pitch. U.S. Pat. No. 5,316,654 taught use of a wiped film evaporator to make high softening point pitch. U.S. Pat. No. 5,429,739 taught use of reduced pressure and partial oxidation, converting a conventional 250° F. softening point pitch to a higher softening pitch in a WFE. The conventional output from a WFE was low, partial oxidation sped up the process. U.S. Pat. No. 5,614,164 taught use of a WFE to make mesophase pitch. The process started with a pitch with a softening point of 93-233° C., processed this in a WFE for 115-300 seconds to produce "enriched pitch" with a 5% maximum mesophase content, then stripped with an inert gas for up to 18 hours to produce the desired pitch product, with a softening point of 177-399° C.

Work on making pitch has continued, but the process could be summarized as follows. Making isotropic pitch from multi-ring aromatics is relatively easy, a thermal polymerization that is relatively straightforward, at least in theory. Isotropic pitch is frequently used as feedstock for production of mesophase pitch. Most mesophase processes relied on quiescent conditions and relatively long reaction times to allow mesophase to form. Pressures are generally high for isotropic pitch processes while mesophase formation is favored by low pressures. The temperatures required to form either type of pitch can be about the same. Great care is required to prevent coking, especially in a mesophase pitch process where the highly condensed multi ring structure is close to, and readily forms, coke on hot metal surfaces.

Our serendipitous accident occurred during work to improve isotropic pitch production as disclosed in Malone and Lee U.S. Pat. No. 9,222,027, Single stage pitch process and product. The process used a tubular reactor to convert an aromatic rich liquid to isotropic pitch. Pressure was above 500 psig to suppress mesophase formation, so that the product isotropic pitch would contain less than 0.5-1.0 wt % mesophase, as mesophase was an undesirable contaminant in an isotropic pitch product.

Liquid hydrocarbon feed, usually slurry oil from FCC units, was used for this isotropic pitch process. Feed was in drums, some under cover while some were stored out in the rain and weather. Significantly different results were achieved depending on where the drums were stored. Some feeds gave higher conversion and to some extent a cleaner reactor. All feeds had about the same amount of aromatics, sulfur and the like. Eventually we realized that the outside feed drums had leaked and water got in. The oil in the drums contained about 10 wt % water, quite a lot considering the feed should have been dry. Tests with wet feed were at first run with whatever water happened to be in the drums, often 10 wt %. We did further testing, using a dry feed and metered steam addition in the amount of about 10 wt %. Steam injection was an attempt to control the process better using controlled steam injection rather than accidental inclusion of rain water. The steam tests were reported in our patent.

As reported in '027 "We ran our tests in a longer tubular reactor with a 900 psig tube outlet pressure. In one series of tests, we added roughly about 1 to 10 wt % steam to the feed with most of the tests done at 10 wt % steam addition. The intent was to see what would happen with steam addition, in the hopes that coking would be reduced. We knew that the steam would be in the vapor phase going through the tube and reduce the residence time of the liquid, roughly by a factor of 4, and set our temperature to maintain the same thermal severity. Less liquid residence time made some of the worst product to date with 12.5 wt % mesophase in the pitch product. When we omitted the steam and increased the liquid feed rate by the same factor to ensure that the liquid residence time, and thermal severity in both runs would be the same, we made the best product to date—most of the feed was converted into pitch in a single pass and the mesophase content of the isotropic pitch product was 0.1 wt %."

In summary, '027 taught making relatively pure isotropic pitch and avoiding contamination with mesophase by eliminating water in the process. Mesophase is a valuable product, usually more valuable than isotropic pitch. Mesophase is hard to make, usually harder to make than isotropic pitch.

Malone and Lee later taught making mesophase pitch from isotropic pitch in a tubular reactor in U.S. Pat. No. 9,376,626, Turbulent mesophase pitch process and products. A tubular reactor and turbulent flow were used, at low pressure and a short residence time, less than 10 seconds, to make mesophase pitch with mesophase contents of 80% or higher. What was extraordinary was making mesophase pitch in such a short time, as low as a second or less.

The state of the art on making mesophase pitch could be summarized as follows. Mesophase is difficult to make as it is so close to coke. Relatively severe conditions are required to form it and great caution required to keep it from going to coke. Relatively long batch processes allow mesophase to form. Some processes used a wiped film evaporator to remove a vaporizable material. All processes are difficult to control as the temperatures used are high and can cause coke to form. Mesophase formation is generally enhanced by low pressure to strip off lighter byproducts or relatively light materials which may be present during thermal polymerization. These processes require residence times of hours up to days to produce the desired mesophase product.

The work of Malone and Lee in '027 taught an efficient way to make isotropic pitch, that was hard to control if water was present or steam was added. '027 taught avoiding steam and making a product with almost no mesophase.

The definition and characteristics of mesophase are worth reviewing. A good summary on the topic is available from the US National Library of Medicine, National Institutes of Health https://www.ncbi.nlm.nih.gov/pubmed/12001208.

Mesoscopic structure and properties of liquid crystalline mesophase pitch and its transformation into carbon fiber. Mochida I1, Yoon S H, Korai Y. Author information Abstract The history and present state of the art in the chemistry of mesophase pitch, which is an important precursor for carbon fiber and other high-performance industrial carbons, are reviewed relative to their structural properties. The structural concepts in both microscopic and macroscopic views are summarized in terms of the sp(2) carbon hexagonal plane as a basic unit common to graphitic materials, its planar stacking in clusters, and cluster assembly into microdomains and domains, the latter of which reflect the isochromatic unit of optical anisotropy. Such a series of structural units is described in a semiquantitative manner corresponding to the same units of graphitic materials, although the size and stacking height of the hexagonal planes (graphitic sheets) are very different. Mesophase pitch is a liquid crystal material whose basic structural concepts are maintained in the temperature range of 250 to 350° C. The melt flow and thermal properties are related to its micro- and mesoscopic structure. The structure of mesophase-pitch-based carbon fiber of high tensile strength, modulus, and thermal conductivity has been formed through spinning, and has inherited the same structural concepts of mesophase pitch. Stabilization settles the structure in successive heat treatments up to 3000° C. Carbonization and graphitization enable growth of the hexagonal planes and their stacking into units of graphite. Such growth is governed and controlled by the alignment of micro- and mesoscopic structures in the mesophase pitch, which define the derived carbon materials as nanostructural materials. Their properties are controlled by the nanoscopic units that are expected to behave as nanomaterials when appropriately isolated or handled."

Mesophase pitch is a liquid crystal. The mesophase content of a sample is determined by grinding and polishing and examining the sample surface. Mesophase pitch content of a sample is reported as area %, rather than a weight % or mole %. Some properties of mesophase pitch survive carbon fiber spinning, carbon fiber made from mesophase "inherited the same structural concepts of mesophase pitch." In short, mesophase is a crystal, a stable one whose structure can survive to some extent spinning, carbonization and graphitization.

We wanted to make mesophase pitch from isotropic pitch but wanted a faster start, if possible. We realized that the best way to grow a crystal is to start with one, i.e. the organic chemistry version of "to catch a thief." Our earlier laboratory work, on making isotropic pitch while avoiding mesophase contamination gave us an idea. Make isotropic pitch with higher levels of mesophase "contamination". Use this "contaminated" isotropic pitch to make mesophase pitch. The higher concentrations of mesophase in the isotropic pitch would act as "seeds" to initiate much faster mesophase crystal formation in the mesophase reactor.

It has been well known since the 1960s (see Brooks, J. D.; Taylor, G. H. 1965. Formation of Graphitizing Carbons from Liquid Phase. *Nature* 206 (4985): 697-699) that large, planar isotropic pitch molecules in a liquid state self-assemble into spherical crystal clusters that can be seen by an optical microscope. Unlike most conventional crystals, the clusters are very stable even in a liquid state over a wide range of temperatures and shear forces. It is believed that the clusters are primarily bound together by van der Waals forces.

When we apply high velocity superheated steam and relatively low pressures to our mesophase tubular reactor, we achieve very interesting results. The Reynolds numbers are around 30,000, which means very high turbulence. The Weber numbers are over 15,000, and possibly over 100,000 (depending upon the liquid mesophase surface tension) which means the liquid isotropic pitch feed is atomized into mist droplets with diameters of around 5-20 microns. These droplets are violently moving and colliding as they race down the reactor at about 150-200 m/sec. These liquid droplets are surrounded by the steam and the lighter hydrocarbons inside the isotropic pitch vaporize and quickly reach thermodynamic equilibrium between the liquid and vapor. The removal of these lighter hydrocarbons from the larger isotropic molecules is important in enabling mesophase crystallization to occur. As the droplets move quickly down the reactor, the isotropic pitch molecules inside are self-assembling into mesophase crystals. The movement of the isotropic molecules into a position to bond with other molecules, which is a mass-transfer limited reaction, is aided by the violent motion of the droplets. The presence of pre-existing mesophase clusters in the droplets at the reactor inlet provides a ready location for the isotropic molecules to attach themselves and speed up the growth of mesophase content.

Faster mesophase crystal growth means a shorter residence time and a shorter reactor. This is important because the velocities in the reactor are very high, requiring a long reactor. It should be noted that curves in the reactor are avoided since high centrifugal force in bends would cause the droplets to collect and coalesce on the internal walls of the reactor, destroying the benefits of the high mass transfer provided by violent droplet motion. Thus, the reactor needs to be long and straight. As we scale the reactor to commercial capacities, the diameter increases and the required velocity to maintain high turbulence also increases, requiring even longer reactors. Thus, being able to minimize the length of the reactor is important.

As mentioned earlier, mesophase pitch is prone to coking at elevated temperatures. When coke builds up inside the reactor, it is necessary to decoke the reactor from time to time, which requires temporarily removing the reactor from production. Lower pressures are preferred for the reactor because, as mentioned above, lower pressure aids removal of lighter hydrocarbons from the isotropic liquid. Coke buildup in the reactor has a negative impact on mesophase conversion because it increases reactor pressure through increased pressure drop across the reactor. Faster mesophase crystal growth allows us to operate the reactor at lower temperatures, thereby reducing coke formation.

We realized that an isotropic pitch product "contaminated with mesophase" was an ideal feedstock for making liquid crystal mesophase pitch, using the mesophase "contamination" to seed further mesophase formation.

BRIEF SUMMARY OF THE INVENTION

The present invention provides a process for producing mesophase pitch from isotropic pitch comprising charging an isotropic pitch feed containing at least 1 wt % mesophase feed to a mesophase forming tubular reactor operating in turbulent flow and converting in said tubular reactor, isotropic pitch to mesophase pitch by self-assembly into spherical crystal clusters to produce a mesophase pitch product.

In another embodiment, the present invention provides a process for producing mesophase pitch from an aromatic rich liquid hydrocarbon feed selected from the group of catalytic cracking slurry oil, ethylene cracker bottoms, coal tar and other highly aromatic hydrocarbons comprising charging said feed and 0.1 to 50 wt % water to a tubular isotropic pitch reactor operating at thermal polymerization conditions including a temperature of 800 to 1000° F., a tubular reactor inlet pressure of 750 to 2500 psia, and thermally polymerizing therein at least a portion of said feed to produce an isotropic pitch intermediate product containing more than 1 wt % mesophase pitch; charging said isotropic pitch intermediate product to a tubular mesophase pitch forming reactor at mesophase forming conditions including fully developed turbulent flow, a tubular reactor inlet pressure less than one half that of said isotropic pitch reactor and operating said tubular mesophase pitch forming reactor at least 90 volume % vapor phase with a velocity exceeding 200 feet per second and forming mesophase pitch in said tubular mesophase pitch forming reactor by self-assembly into spherical crystal clusters to produce a mesophase pitch product with less than 50% isotropic pitch.

DETAILED DESCRIPTION OF PREFERRED EMBODIMENTS

Our process does not require a new feedstock, plant or process flow. We operate the isotropic pitch process to ensure sufficient mesophase contamination of the isotropic pitch product. Contamination can be ensured thermally or preferably with water, steam, or inert gases, e.g. He, $N_2$, and $CO_2$. It can be done thermally by running the plant harder, e.g., a higher reaction temperature and/or longer reaction time to ensure mesophase is formed which ends up in the isotropic pitch product. Preferably the additive approach is used, steam or water to the feed to the isotropic pitch reactor to contaminate the product and keep the reactor clean. Water or steam is believed to favor the production of mesophase pitch in the isotropic pitch reactor and also reduce coking, based on visual observations.

The basic process, and process flow diagram, for making both isotropic and mesophase pitch remains the same as disclosed in our issued patents, which have been incorporated by reference.

Any conventional aromatic rich hydrocarbons traditionally used to prepare isotropic pitch may be used. We used slurry oil, the bottoms product recovered from the FCC column main fractionator, as feed for the isotropic pitch reactor. Similar results will be achieved with similar streams, e.g., ethylene cracker bottoms.

Our new approach should also work with coal tar as a feedstock, but we have not tested this feedstock yet.

The feed to the mesophase forming reactor is isotropic pitch containing, sufficient mesophase to seed mesophase formation in the tubular mesophase forming reactor.

Experiments—Isotropic Pitch Reactor

The experiments which follow show operation of the isotropic pitch reactor to form an isotropic pitch product with mesophase contamination.

We used a 9.52 mm (⅜") outside diameter (OD) tube 15.24 m (50 ft.) long with a 0.711 mm (0.028") wall thickness made of type 316 L stainless steel (ss) heated by a Miller 300 CP welding machine that passed current through the reactor tube for our experimental studies. The residue and overhead were drained every 2 hours. Samples from these drains were analyzed for softening point and once for coking value. The lab notebooks are abstracted below.

Experiment 1

This run noted that 10% water by weight was added to the feed barrel.

This produced pitch with a softening point of 103-124° C. and coking values between 52-59%

Feed was at 6.2 lb/hr with the coils at between 985-990° F.

Shutdown was due to blockage in the coil tube, most likely due to coking.

A sample of the product was polished and a mesophase content was determined to be approximately 1%.

Experiment 2

Another run was conducted with 10% by weight of water in the feed.

This produced a pitch with a softening point of approximately 100° F. and a mesophase content of 10-15%.

Discussion

Our new process, using mesophase "contaminated" feed to seed and make mesophase pitch will improve the operation of a mesophase pitch plant. We prefer to make isotropic pitch contaminated with 1, 2, 5, 10 or 20 wt % mesophase. Even more mesophase "contamination" can be tolerated, 25, 30, 40 wt % or more, but we prefer to use conditions in the isotropic pitch plant which favor isotropic pitch and leave most mesophase formation to the mesophase reactor. The mesophase reactor preferably operates at less than half, preferably one fourth or less, of the pressure in the isotropic pitch plant.

Preferably the isotropic pitch plant is closely coupled with a mesophase pitch plant, preferably close enough that molten "contaminated" isotropic pitch can be directly charged to the mesophase pitch plant. For this use, the presence of some mesophase is beneficial and shifts some of the work normally done in the mesophase plant to the isotropic pitch plant. For this use, where the isotropic pitch plant functions as feed prep for the mesophase pitch plant, higher amounts of mesophase pitch are preferred, from 5 wt % mesophase to 10, 15, 20, 25, 30 wt % mesophase or more.

Any conventional isotropic pitch plant or process may be used to create a contaminated or mesophase containing isotropic pitch. When a tubular reactor process is used, preferred operating conditions are 800-1000° F., 800-2000 psi inlet pressure, one to 20 minutes residence time, 1-20 ft/sec average velocity and 30-80 vol % vapor (avg).

Ideally, the "contaminated" isotropic pitch is kept as a liquid and charged as a liquid to the mesophase reactor within 24 hours, preferably within 1 hour and ideally within 5 minutes or less. There is some heat savings and, more importantly, the contaminated product from the isotropic pitch reactor will not separate. If we have hot feed from the isotropic pitch plant to the mesophase pitch plant, the feed is homogeneous.

Our preferred mesophase forming reactor when making a mesophase product can operate at conventional conditions such as those disclosed in U.S. Pat. No. 9,376,626, discussed previously. In general, preferred tubular reactor operating conditions are 750-900° F., 30-100 psi inlet pressure, 200-1000 ft/sec velocity (avg) and 99.9+ vol % vapor.

While thermal conditions alone can generate isotropic pitch with a sufficient amount of mesophase to promote seeding, we prefer to add 0.1 to 50 wt %, preferably 1 to 10 wt %, water or steam to the isotropic pitch reactor feed because adding water or steam to the isotropic pitch reactor will reduce coke formation. When liquid water is added to or present in the feed, it will turn into steam at reactor operating temperatures.

We claim:

1. A process for producing mesophase pitch from isotropic pitch comprising a. Charging an isotropic pitch feed containing at least 10 wt % mesophase feed to a mesophase forming tubular reactor operating in turbulent flow and b. converting in said tubular reactor, isotropic pitch to mesophase pitch by self-assembly into spherical crystal clusters to produce a mesophase pitch product.

2. The process of claim 1 wherein said mesophase forming tubular reactor is a straight tube.

3. The process of claim 1 wherein said isotropic pitch is formed in a tubular reactor operating at thermal polymerization conditions including a temperature above 600° F. and pressure above 500 psia.

4. The process of claim 3 wherein 0.1 to 50 wt % water is in the feed to said isotropic pitch reactor.

5. The process of claim 3 wherein 1 to 10 wt % water is in the feed to said isotropic pitch reactor.

6. The process of claim 1 wherein at least 90% by volume of flow within said mesophase forming tubular reactor is vapor.

7. The process of claim 1 wherein at least 99% by volume of flow within said mesophase forming tubular reactor is vapor.

8. The process of claim 1 wherein at least 99.9% by volume of flow within said mesophase forming tubular reactor is vapor.

9. The process of claim 3 wherein said isotropic pitch reactor effluent discharges into a vapor liquid flash separator to produce a separator isotropic pitch liquid product containing more 10 wt % mesophase pitch.

10. The process of claim 3 wherein an aromatic liquid selected from the group of catalytic cracking slurry decant oil, ethylene cracker bottoms, coal tar pitch and other highly aromatic hydrocarbons is fed to said isotropic pitch reactor.

11. The process of claim 3 wherein said thermal polymerization conditions include a superficial vapor velocity in said isotropic pitch forming tubular reactor of 0.5 to 100 ft/sec.

12. The process of claim 11 wherein said superficial vapor velocity is 2 to 25 ft/sec.

13. A process for producing mesophase pitch from an aromatic rich liquid hydrocarbon feed selected from the group of catalytic cracking slurry decant oil, ethylene cracker bottoms and coal tar comprising a. Charging said feed and 0.1 to 50 wt % water to a tubular isotropic pitch reactor operating at thermal polymerization conditions including a temperature of 800 to 1000° F., a tubular reactor inlet pressure of 750 to 2500 psia, and thermally polymerizing therein at least a portion of said feed to produce an isotropic pitch intermediate product containing more than 10 wt % mesophase pitch;

b. Charging said isotropic pitch intermediate product to a tubular mesophase pitch forming reactor at mesophase forming conditions including fully developed turbulent flow, a tubular reactor inlet pressure less than one half that of said isotropic pitch reactor and operating said tubular mesophase pitch forming reactor with at least 90 volume % vapor phase and with a velocity exceeding 200 feet per second and forming mesophase pitch in said tubular mesophase pitch forming reactor by self-assembly into spherical crystal clusters to produce a mesophase pitch product with less than 50% isotropic pitch.

14. The process of claim 13 wherein said mesophase tubular reactor is a straight tube.

15. The process of claim 13 wherein said tubular isotropic pitch reactor operates at 800 to 1000° F., a tubular reactor inlet pressure of 800 to 2000 psia, a residence time of 1 to 20 minutes, an average velocity of 1 to 20 ft/sec, and operates with 30 to 80 vol % vapor phase within said tubular reactor.

16. The process of claim 13 wherein said mesophase reactor operating conditions are 750 to 900° F., a 30 to 100 psia inlet pressure, 200 to 1000 ft/sec average velocity and 99.9+ vol % vapor phase within said tubular reactor.

* * * * *